US010927628B2

(12) United States Patent
Braun et al.

(10) Patent No.: US 10,927,628 B2
(45) Date of Patent: Feb. 23, 2021

(54) DRILLING BUCKET AND METHOD FOR PRODUCING A BORE IN THE GROUND

(71) Applicant: BAUER Maschinen GmbH, Schrobenhausen (DE)

(72) Inventors: Roland Artur Braun, Aindling (DE); Manfred Schweiger, Tandern (DE); Fabian Denk, Vohburg (DE); Ulli Wiedenmann, Schrobenhausen (DE); Andreas Stimpfle-Ziegler, Kühbach (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 16/840,270

(22) Filed: Apr. 3, 2020

(65) Prior Publication Data

US 2020/0318450 A1 Oct. 8, 2020

(30) Foreign Application Priority Data

Apr. 4, 2019 (DE) ..... 10 2019 108 806

(51) Int. Cl.
*E21B 27/00* (2006.01)
*E21B 7/00* (2006.01)
*E21B 10/42* (2006.01)

(52) U.S. Cl.
CPC ..... *E21B 27/00* (2013.01); *E21B 7/003* (2013.01); *E21B 10/42* (2013.01)

(58) Field of Classification Search
CPC ..... E21B 7/006; E21B 7/00; E21B 10/42
See application file for complete search history.

(56) References Cited

U.S. PATENT DOCUMENTS 183,467 A * 10/1876 Pierce ..... E21B 7/006 175/318
1,210,196 A 12/1916 Nelson
2,245,750 A * 6/1941 Betts ..... E21B 27/00 175/57
2,529,246 A * 11/1950 Detrick ..... E21B 7/006 175/122
2,873,950 A * 2/1959 Kandle ..... E21B 4/18 175/94
3,232,361 A * 2/1966 Haspert ..... E21B 6/00 175/102
3,420,320 A * 1/1969 Washita ..... E21B 7/006 175/161
4,156,471 A * 5/1979 Wagner ..... E21B 7/006 175/310

(Continued)

*Primary Examiner* — Benjamin F Fiorello
(74) *Attorney, Agent, or Firm* — Studebaker & Brackett PC

(57) ABSTRACT

The invention relates to a drilling bucket and a method for producing a bore with a drilling bucket, wherein the drilling bucket is driven in a rotating manner and introduced into the ground, wherein ground material is removed and received in an internal space of a tubular base body of the drilling bucket, and for emptying the drilling bucket is withdrawn from the bore and a bottom on the tubular base body is folded open. According to the invention the drilling bucket is rotated in a reversing manner during emptying, wherein ground material received in the drilling bucket is pressed against at least one impact wall and, in doing so, the ground material is specifically compacted and deformed for easier loosening from the internal space.

8 Claims, 4 Drawing Sheets

(56) References Cited

U.S. PATENT DOCUMENTS

Figure 1:
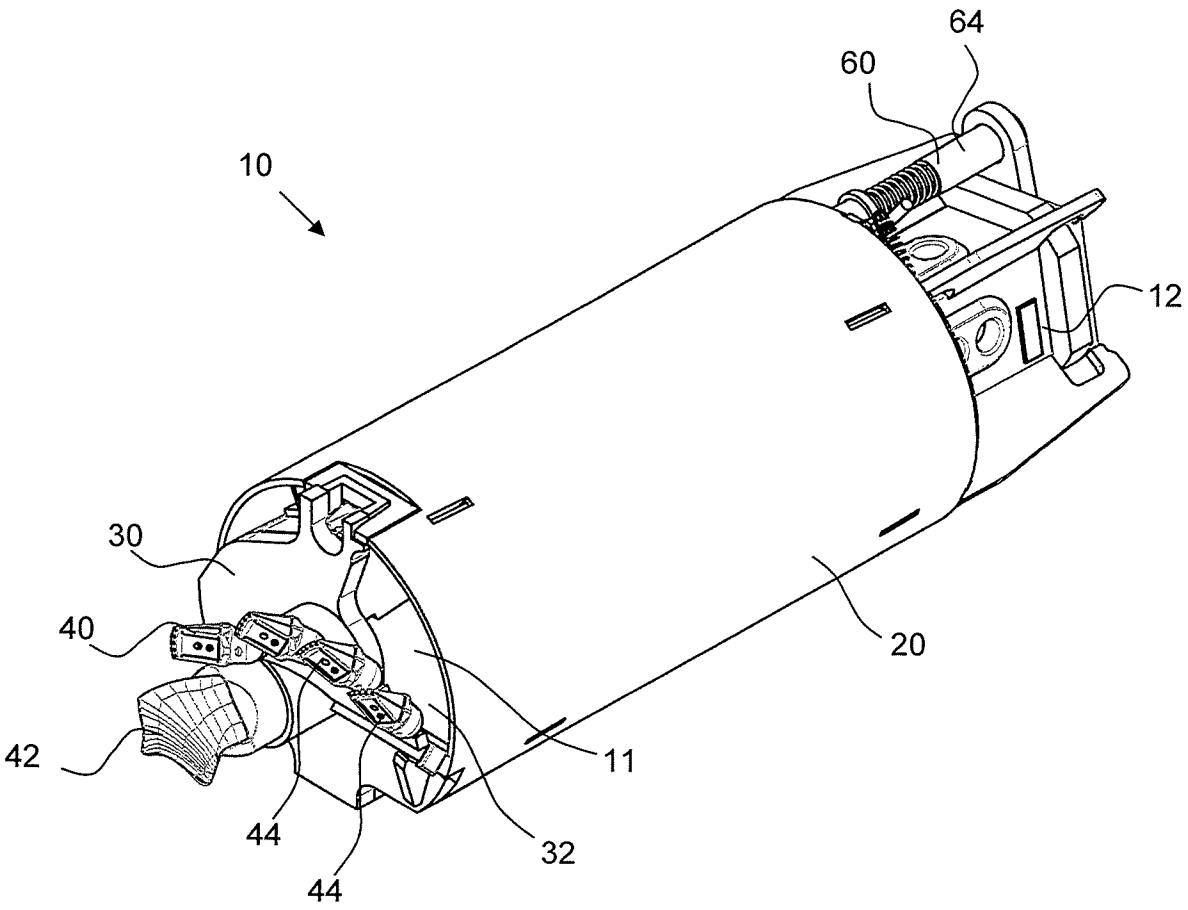

| | | | | |
|---|---|---|---|---|
| 4,971,163 | A * | 11/1990 | Ohashi | E21B 7/003 175/161 |
| 5,224,548 | A * | 7/1993 | Dankovich, II | E21B 7/006 166/311 |
| 7,546,887 | B2 * | 6/2009 | Schwab | E21B 7/005 175/323 |
| 9,376,880 | B2 * | 6/2016 | Stimpfle-Ziegler | E21B 10/44 |
| 2005/0241859 | A1 * | 11/2005 | Lee | E21B 7/006 175/331 |
| 2013/0269220 | A1 | 10/2013 | Matthias et al. | |
| 2014/0262522 | A1 * | 9/2014 | Watson | E21B 27/00 175/57 |
| 2016/0251899 | A1 * | 9/2016 | Watson | E21B 10/325 175/161 |

* cited by examiner

DRILLING BUCKET AND METHOD FOR PRODUCING A BORE IN THE GROUND

The invention relates to a drilling bucket having a tubular base body, on the upper side of which a connecting means to a drill bar is arranged and on the underside of which a bottom is supported such that it can be folded open, wherein on the bottom a cutting means for removing ground material and at least one through-opening are provided, which is designed for the passage of removed ground material into an internal space of the tubular base body.

The invention further relates to a method for producing a bore in the ground with such a drilling bucket, wherein the drilling bucket is driven in a rotating manner and introduced into the ground, wherein ground material is removed and received in an internal space of a tubular base body of the drilling bucket, and for emptying the drilling bucket is withdrawn from the bore and a bottom on the tubular base body is folded open.

Such drilling buckets, which are also referred to as boring buckets, have been known for decades and are used for the discontinuous production of a bore in the ground. In this process, the drilling bucket is introduced in a rotating manner into the ground by means of a drill bar. By way of a cutting means ground material is removed and conveyed via a through-opening on the bottom of the drilling bucket into an internal space until this has reached a desired filling level. Subsequently, the through-opening is closed and the drilling bucket is withdrawn with the drill bar from the borehole and moved to an emptying position. There, emptying of the drilling bucket does not take place via the through-opening but by unlocking and folding the bottom of the drilling bucket open. In the case of loose ground material the drilling bucket can thus be emptied relatively easily.

In the case of cohesive ground material, such as clay, and when the filling level of the drilling bucket is relatively high the ground material can remain stuck in the drilling bucket and does not simply fall out of the internal space under the effect of gravity. In such a case it is common practice that a driver of the drilling apparatus sets the drilling bucket into a vibratory movement in order to dislodge the adhering ground material from the drilling bucket. If this is not achieved or insufficiently achieved through vibration it is necessary to interrupt the drilling process, move the drilling bucket close to the ground and free this manually by staff from the adhering ground material.

Such a manual cleaning is time-consuming and therefore cost-intensive. Moreover, staff has to enter the operating range of a drilling apparatus which can be problematic for work safety reasons.

The invention is based on the object to provide a drilling bucket and a method for producing a bore in the ground, with which a particularly reliable and safe emptying of a drilling bucket can be achieved.

In accordance with the invention the object is achieved by a drilling bucket having a tubular base body, on the upper side of which a connecting means to a drill bar is arranged and on the underside of which a bottom is supported such that it can be folded open, wherein on the bottom a cutting means for removing ground material and at least one through-opening are provided, which is designed for the passage of removed ground material into an internal space of the tubular base body, and a method for producing a bore in the ground with a drilling bucket, in which the drilling bucket is driven in a rotating manner and introduced into the ground, wherein ground material is removed and received in an internal space of a tubular base body of the drilling bucket, and for emptying the drilling bucket is withdrawn from the bore and a bottom of the tubular base body is folded open, wherein the drilling bucket is rotated in a reversing manner during emptying, wherein ground material received in the drilling bucket is pressed against at least one impact wall and, in doing so, the ground material is specifically compacted and deformed for easier loosening from the internal space. According to preferred embodiments of the invention, with respect to the drilling bucket, the at least one impact wall may have a run-in radius and/or a run-out radius, two impact walls may be provided which lie opposite each other in the internal space, the tubular base body may be of cylindrical or conical design on the internal side, the at least one impact wall may be designed so as to be inclined with respect to a longitudinal axis of the tubular base body, through the at least one impact wall a rear space may be separated from the internal space, in which lines and/or a linkage are arranged, and the bottom may have a closing plate capable of turning, with which the at least one through-opening can be closed. According to preferred embodiments of the invention, with respect to the method, the created bore may be filled with a hardenable mass, wherein a pile-shaped foundation element is produced.

The drilling bucket according to the invention is characterized in that in the internal space of the tubular base body at least one impact wall is fixed which substantially extends over the entire axial length of the internal space, limits the internal space of the tubular base body in some areas and forms an impact surface for ground material received in the internal space.

A finding of the invention is based on the fact that cohesive ground material in the internal space of a drilling bucket can form a plug which, despite stronger vibratory movements, remains in the drilling bucket not only because of its adhesive forces with the walls of the drilling bucket but also due to a suction or negative pressure effect. According to a basic idea of the invention a cylindrical or rotationally symmetrical shape of the internal space is specifically interrupted. According to an aspect of the invention at least one impact wall is arranged in the internal space so that on reversing rotation of the drilling bucket ground material located therein is specifically and repeatedly pressed against this impact surface in the internal space. In this way, on the one hand the shape of a ground material plug inside the internal space is changed and preferably reduced such that a free space is formed along the plug, whereby the generation of negative pressure between an upper side of the ground material plug and the drilling bucket is counteracted. On the other hand, during reversing rotation of the drilling bucket the impact wall according to the invention brings about an additional force onto the ground material in the circumferential direction of the drilling bucket, which helps to overcome the lateral adhesive forces of ground material in the drilling bucket through movement of the ground material in the circumferential direction.

By way of the drilling bucket according to the invention a loosening of ground material, more particularly cohesive ground material, in the drilling bucket can thus be facilitated considerably so that a manual emptying of the drilling bucket by staff can practically be avoided or at least be reduced to a large degree. This not only increases work safety but also ensures a reliable and efficient process of a drilling method with a drilling bucket.

A preferred embodiment of the invention resides in the fact that the at least one impact wall has a run-in radius and/or a run-out radius. Despite the impact wall provided in the drilling bucket this still ensures an introduction of the removed ground material with the least possible friction into the internal space of the tubular base body during drilling.

Basically, provision can be made for a plurality of impact walls on the internal side of the tubular base body. A particularly advantageous embodiment of the drilling bucket is achieved in that two impact walls are provided which lie opposite each other in the internal space. This results in a mutual intensification of the impact forces during vibration of the drilling bucket due to reversing rotation.

Furthermore, a preferred embodiment of the invention can be achieved in that the tubular base body is of cylindrical or conical design. A cylindrical shape can be produced particularly economically. A conical shape of a base body, in which this tapers towards its upper side, fosters loosening of adhering ground material, especially of a ground material plug in the internal space.

Basically, the impact wall can extend in parallel to a longitudinal axis or drilling axis of the drilling bucket. According to a further development of the invention the effect of loosening of the ground material is improved further in that at least one impact wall is designed so as to be inclined with respect to a longitudinal axis of the tubular base body. In particular, the inclination is designed such that a distance of the impact wall to the longitudinal axis decreases in the upward direction.

Basically, the at least one impact wall can be formed on the tubular base body or can be designed integrally therewith. According to a further development of the invention it is especially expedient that through the at least one impact wall a rear space is separated from the internal space, in which lines or a linkage are arranged. The line can be a hose line or a ventilation duct which extend along the drilling bucket in the rear space. Furthermore, in the rear space a locking mechanism, in particular a linkage for unlocking the bottom plate, can also be provided, in which case the linkage preferably extends from an underside of the drilling bucket up to an upper side and beyond. By preference, the impact wall is a plate-shaped element that is inserted, preferably welded into the base body.

When drilling cohesive ground material there is basically no need for a closing plate for closing the at least one through-opening on the bottom of the drilling bucket since the cohesive ground material largely stays by itself in the internal space when the drilling bucket is withdrawn from the borehole. If ground layers containing loose ground material, for instance sand or gravel, are also to be penetrated, it is preferred in accordance with an embodiment variant of the invention that the bottom has a closing plate capable of turning, with which the at least one through-opening can be closed. The closing plate is supported in a rotatable manner such that it is moved into an open position in a rotational direction of drilling, whereas in the opposite rotational direction the closing plate is turned relative to the bottom so that the closing plate is thereby moved into a closing position, in which it closes the at least one through-opening.

With regard to the method the invention is characterized in that the drilling bucket is rotated in a reversing manner during emptying, wherein ground material received in the drilling bucket is pressed against at least one impact wall and, in doing so, the ground material is specifically compacted and deformed for easier loosening from the internal space.

The method can be carried out, in particular, by way of the previously described drilling bucket which is fixed on a conventional soil drilling apparatus. The drill bar can be a simple drill bar or a telescopic drill rod, a so-called Kelly bar.

Reversing rotation of the drilling bucket can take place only after the bottom has been folded open or even as early as when the bottom is still in its folded-shut position on the tubular base body so that the compacted ground material forms a plug that can be loosened easily.

According to a further development of the invention a preferred method variant resides in the fact that the created bore is preferably filled with a hardenable mass, wherein a pile-shaped foundation element is produced. In particular, a foundation pile can be produced with a concrete mass.

Figure 2:
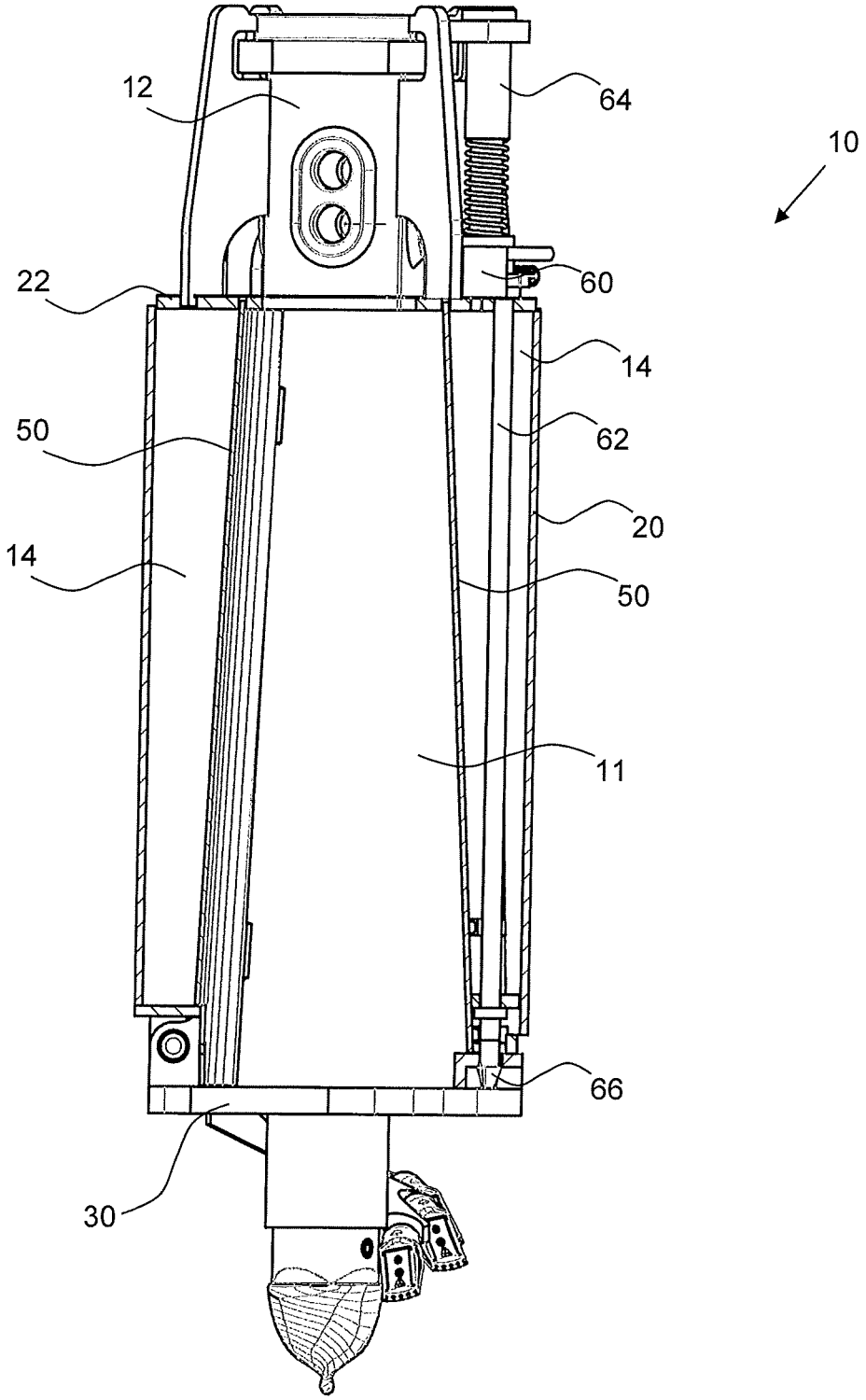
Figure 3:
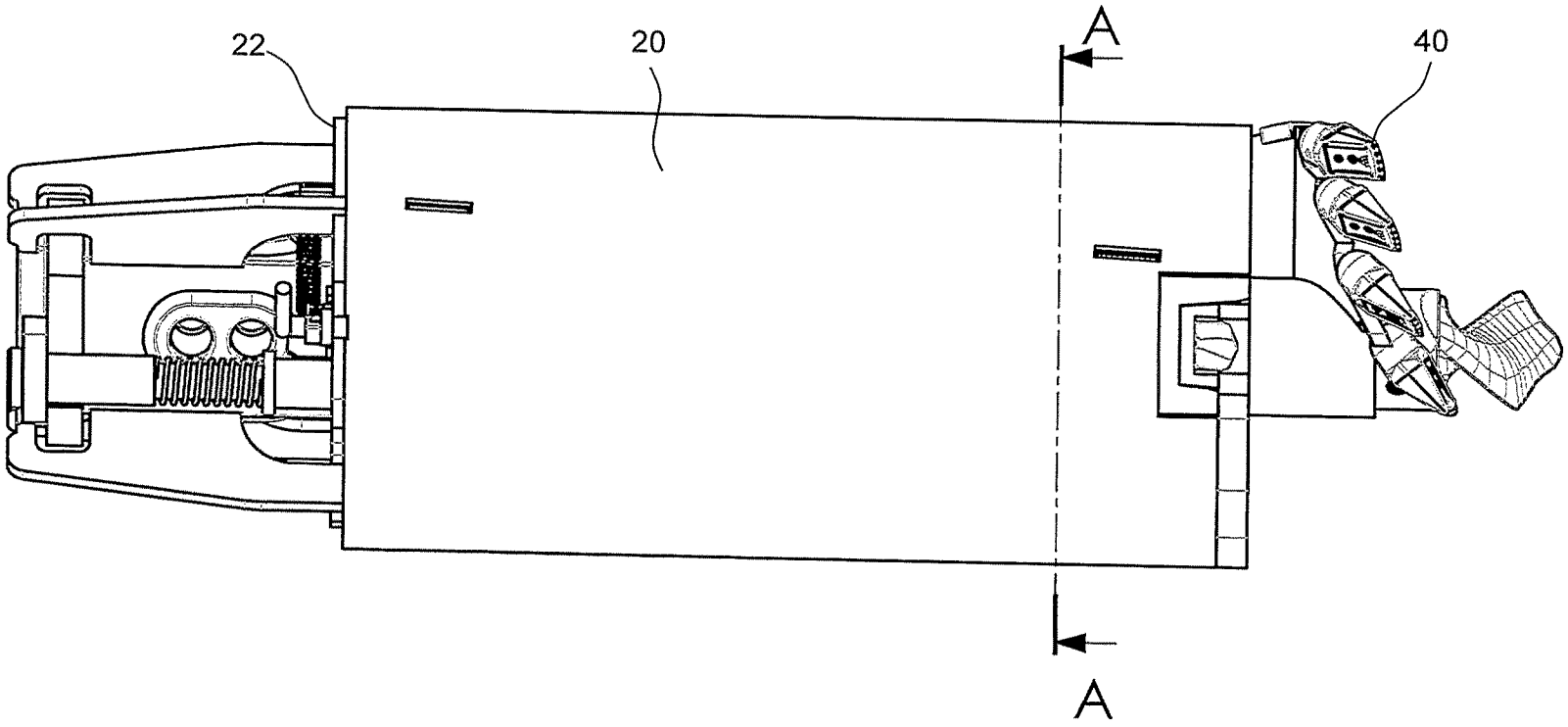

The invention is described further hereinafter by way of a preferred embodiment illustrated schematically in the accompanying drawings, wherein show:

FIG. 1 a perspective view of a drilling bucket according to the invention;

FIG. 2 a partially sectional side view of the drilling bucket of FIG. 1;

FIG. 3 a side view of the drilling bucket of FIGS. 1 and 2; and

Figure 4:
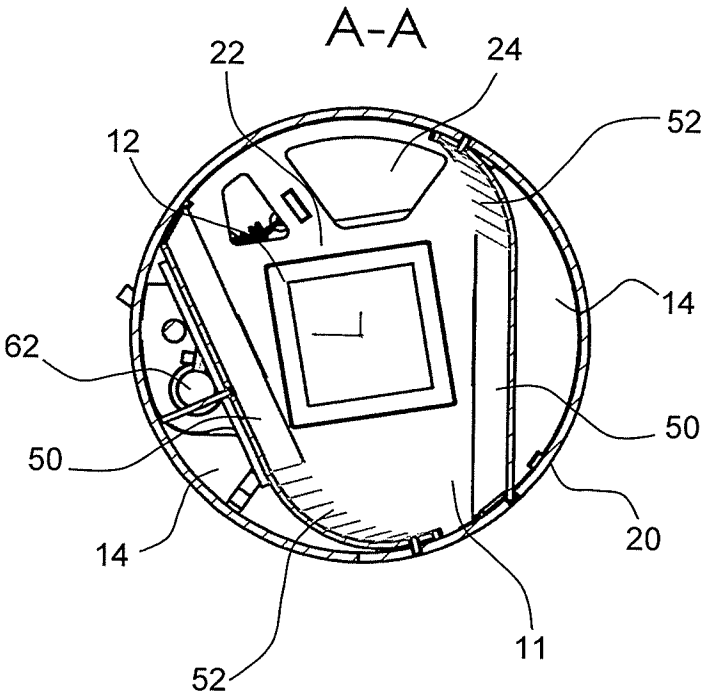

FIG. 4 a cross-sectional view according to section A-A of FIG. 3.

A drilling bucket 10 pursuant to the invention and according to FIG. 1 has a cylindrical tubular base body 20, on the upper side of which a connecting means 12 for a drill bar is fixed. On its underside directed towards the ground the tubular base body 20 has a plate-shaped bottom 30, on which a cutting means 40 for removing ground material is arranged. The cutting means 40 comprises a central, protruding pilot bit 42, from which several cutting teeth 44 extend helically up to a through-opening 32 in the bottom 30. The through-opening 32 is designed for the passage of removed ground material into an internal space 11 of the tubular base body 20.

To empty the internal space 11 the bottom 30 can be opened by means of a locking means 60 from a locked position illustrated in FIG. 1. The locking means 60 comprises an actuating pin 64 on the upper side of the tubular base body 20 in the area of the connecting means 12.

As shown in greater detail in FIG. 2, a linkage 62 located in the interior of the tubular base body 20 is actuated by the spring-supported actuating pin 64, whereby a lower latch section 66 releases the plate-shaped bottom 30. The plate-shaped bottom 30 can be pivoted open in the downward direction via a lateral pivot joint 36 that is directed transversely to a longitudinal or drilling axis of the drilling bucket 10. In this pivoted-open position ground material inside the internal space 11 can be emptied at an emptying position. To close the bottom 30 this is simply pressed downwards against the ground with the drilling bucket 10, whereby the bottom 30 pivots back and is locked again in the latch section 66 in a substantially horizontal position.

The linkage 62 is arranged in a rear space 14 of the tubular base body 20, in which case the rear space 14 is separated by means of an impact wall 50 from the internal space 11 provided for receiving the ground material, as illustrated in greater detail in FIGS. 3 and 4 in particular.

In the illustrated drilling bucket 10 according to the invention a total of two impact walls 50 are arranged in the internal space 11, which lie substantially opposite each other and extend along the entire internal space 11 from the bottom 30 to a cover plate 22 on the upper side of the tubular base body 20. In the cover plate 22 an opening 24 for pressure compensation is provided. The impact walls 50 narrow the internal space 11 of the tubular base body 20, wherein run-in radii 52 are provided for easier entry and distribution of the removed ground material in the internal space 11. These follow a planar plate-shaped section of the impact walls 50 and, at least on one side of the impact wall 50, form a transition to an internal wall of the tubular base body 20.

The impact walls 50 are arranged so as to be inclined with respect to the longitudinal axis of the drilling bucket 10, in which case the distance of the impact walls 50 to the longitudinal axis tapers in the upward direction. In this way, the internal space 11 is designed such that it is conically tapered in the upward direction which facilitates downward-emptying of the ground material inside the internal space 11.

The rear space 14, which is in each case separated from the internal space 11 by the impact walls 50 and formed between the impact walls 50 and the internal wall of the tubular base body 20, serves to receive the linkage 62 of the locking means 60 or further lines and components not depicted here.

The invention claimed is:

1. Drilling bucket having a tubular base body, on the upper side of which a connecting means to a drill bar is arranged and on the underside of which a bottom is supported such that it can be folded open, wherein on the bottom a cutting means for removing ground material and at least one through-opening is provided, which is designed for the passage of removed ground material into an internal space of the tubular base body, wherein in the internal space of the tubular base body at least one impact wall is fixed which substantially extends over the entire axial length of the internal space, limits the internal space of the tubular base body in some areas and forms an impact surface for ground material received in the internal space, and the at least one impact wall is designed so as to be inclined with respect to a longitudinal axis of the tubular base body and a distance of the at least one impact wall decreases from the longitudinal axis upwards.

2. Drilling bucket according to claim 1, wherein the at least one impact wall has a run-in radius and/or a run-out radius.

3. Drilling bucket according to claim 1, wherein two impact walls are provided which lie opposite each other in the internal space.

4. Drilling bucket according to claim 1, wherein the tubular base body is of cylindrical or conical design on the internal side.

5. Drilling bucket according to claim 1, wherein through the at least one impact wall a rear space is separated from the internal space, in which lines and/or a linkage are arranged.

6. Drilling bucket according to claim 1, wherein the bottom has a closing plate capable of turning, with which the at least one through-opening can be closed.

7. Method for producing a bore in the ground with a drilling bucket according to claim 1, in which the drilling bucket is driven in a rotating manner and introduced into the ground, wherein ground material is removed and received in an internal space of a tubular base body of the drilling bucket, and for emptying the drilling bucket is withdrawn from the bore and a bottom of the tubular base body is folded open, wherein the drilling bucket is rotated in a reversing manner during emptying, wherein ground material received in the drilling bucket is pressed against at least one impact wall and, in doing so, the ground material is specifically compacted and deformed for easier loosening from the internal space.

8. Method according to claim 7, wherein the created bore is filled with a hardenable mass, wherein a pile-shaped foundation element is produced.

* * * * *